US006253761B1

(12) United States Patent
Shuler et al.

(10) Patent No.: US 6,253,761 B1
(45) Date of Patent: Jul. 3, 2001

(54) SENSING DEVICE FOR STOVES

(76) Inventors: Timothy Edward Shuler; Magdalena Wisniewska, both of P.O. Box 250220, New York, NY (US) 10025

( * ) Notice: Subject to any disclaimer, the term of this patent is extended or adjusted under 35 U.S.C. 154(b) by 0 days.

(21) Appl. No.: 09/499,569

(22) Filed: Feb. 7, 2000

Related U.S. Application Data

(60) Provisional application No. 60/123,318, filed on Mar. 5, 1999.

(51) Int. Cl.[7] ..... F24C 3/12

(52) U.S. Cl. ..... 126/42; 126/39 BA; 219/518

(58) Field of Search ..... 126/39 R, 39 E, 126/39 BA, 42 R; 219/518, 447.1

(56) References Cited

U.S. PATENT DOCUMENTS 2,410,014 * 10/1946 Clark ..... 219/518
5,243,172 * 9/1993 Hazen et al. ..... 219/447.1
5,491,423 * 2/1996 Turetta ..... 219/447.1
5,658,478 * 8/1997 Roeschel et al. ..... 219/518

FOREIGN PATENT DOCUMENTS

2465163 * 4/1981 (FR) ..... 219/518
2645660 * 10/1990 (FR) ..... 126/42
673083 * 10/1990 (GB) ..... 126/42

* cited by examiner

*Primary Examiner*—James C. Yeung
(74) *Attorney, Agent, or Firm*—Goldstein Law Offices P.C.

(57) ABSTRACT

A sensing device for stoves including a gas stove having at least one burner and a gas supply conduit for supply gas to the burner. The burner has a control dial for controlling the flow of gas to the burner. A weight sensor is disposed below the burner of the gas stove. The weight sensor is in communication with the control dial. The weight sensor sends a first signal when a cooking utensil is disposed on the burner to allow for gas to be supplied to the burner and a second signal when a cooking utensil is not disposed on the burner to stop the gas from being supplied to the burner.

2 Claims, 2 Drawing Sheets

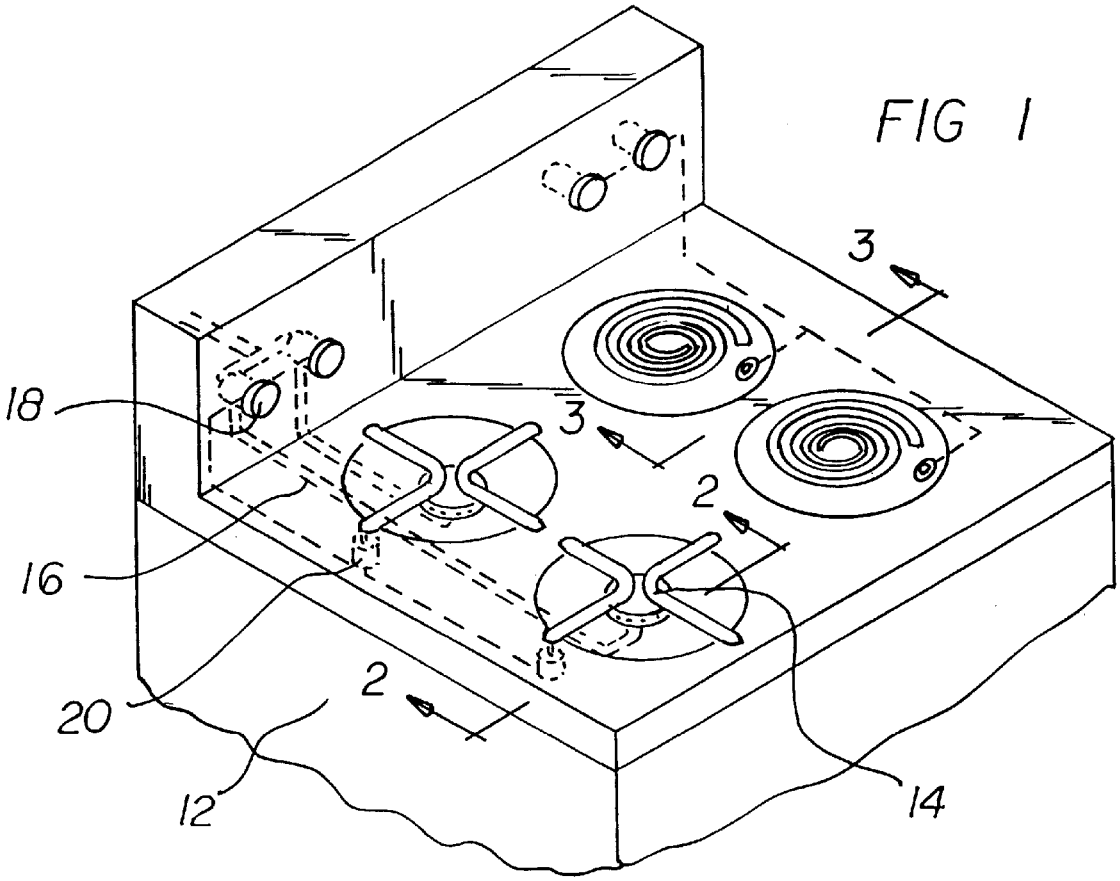
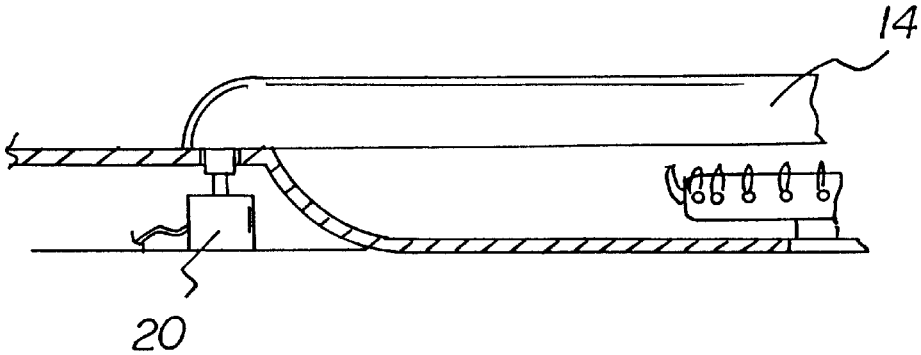
FIG 2

FIG 3
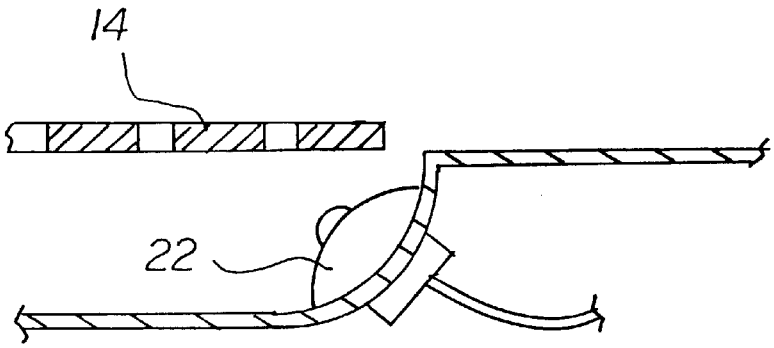
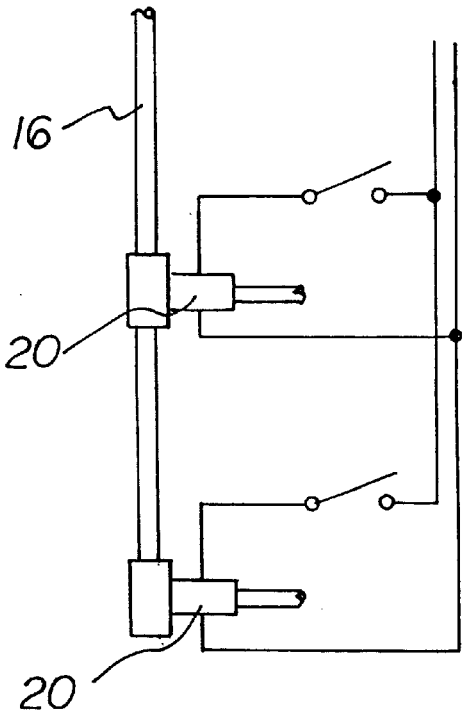
FIG 4A
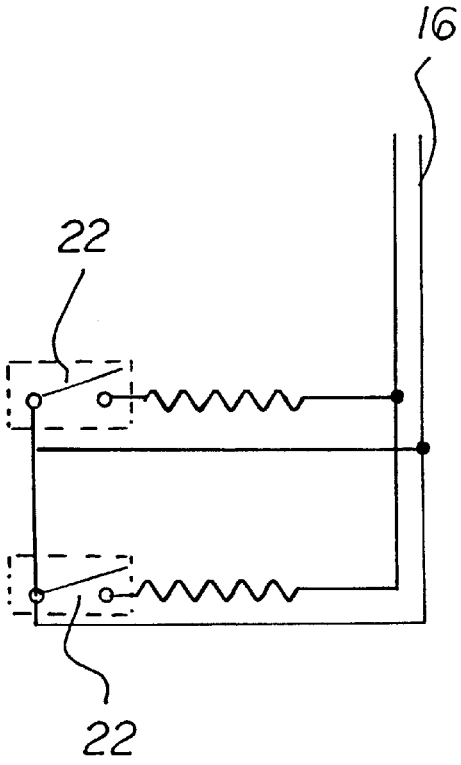
FIG 4B

SENSING DEVICE FOR STOVES

CROSS REFERENCES AND RELATED SUBJECT MATTER

This application relates to subject matter contained in provisional patent application Ser. No. 60/123,318, filed in the United States Patent & Trademark Office on Mar. 5, 1999.

BACKGROUND OF THE INVENTION

The present invention relates to a sensing device for stoves and more particularly pertains to detecting the absence of a pot or the like on a stove to automatically shut down a power source of the stove.

Gas stoves are commonly used in commercial and domestic kitchens. One problem with the use of gas stoves in restaurants is that the chefs often leave the burners burning when they are not in use, and this wastes fuel. Also, gas stoves used domestically present a hazard when the main gas valve is left open and the pilot light is out. In an effort to solve this problem, various mechanical devices and linkages have been proposed for shutting off the supply of gas to the burner when a utensil is not on the burner. Unfortunately, many of the mechanical devices are relatively complex and are subject to sticking or fouling when contaminated by greases and other cooking material. Additionally, similar problems exist with electric burners. The present invention attempts top provide a means for sensing the existence of a cooking utensil whereupon the non-existence of the cooking utensil will turn the power off.

The use of automatic shutoff mechanisms is known in the prior art. More specifically, automatic shutoff mechanisms heretofore devised and utilized for the purpose of shutting off a gas supply based on a preselected pattern of activity are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,628,242 to Higley discloses a gas grill with automatic shut off controlled by dynamic sensor. U.S. Pat. No. 5,094,259 to Hsu discloses an automatic shut-off safety device for gas stove fitted between the gas intake pipe and the catch base. U.S. Pat. No. 4,681,084 to Grech discloses a burner control system comprised of a solenoid valve.

While these devices fulfill their respective, particular objective and requirements, the aforementioned patents do not describe a sensing device for stoves for detecting the absence of a pot or the like on a stove to automatically shut down a power source of the stove.

In this respect, the sensing device for stoves according to the present invention substantially departs from the conventional concepts and designs of the prior art, and in doing so provides an apparatus primarily developed for the purpose of detecting the absence of a pot or the like on a stove to automatically shut down a power source of the stove.

Therefore, it can be appreciated that there exists a continuing need for new and improved sensing device for stoves which can be used for detecting the absence of a pot or the like on a stove to automatically shut down a power source of the stove. In this regard, the present invention substantially fulfills this need.

SUMMARY OF THE INVENTION

In the view of the foregoing disadvantages inherent in the known types of automatic shutoff mechanisms now present in the prior art, the present invention provides an improved sensing device for stoves. As such, the general purpose of the present invention, which will be described subsequently in greater detail, is to provide a new and improved sensing device for stoves and method which has all the advantages of the prior art and none of the disadvantages.

To attain this, the present invention essentially comprises a gas stove having at least one burner and a gas supply conduit for supply gas to the burner. The burner has a control dial for controlling the flow of gas to the burner. A weight sensor is disposed below the burner of the gas stove. The weight sensor is in communication with the control dial. The weight sensor sends a first signal when a cooking utensil is disposed on the burner to allow for gas to be supplied to the burner and a second signal when a cooking utensil is not disposed on the burner to stop the gas from being supplied to the burner.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sensing device for stoves which has all the advantages of the prior art automatic shutoff mechanisms and none of the disadvantages.

It is another object of the present invention to provide a new and improved sensing device for stoves which may be easily and efficiently manufactured and marketed.

It is a further object of the present invention to provide a new and improved sensing device for stoves which is of durable and reliable construction.

An even further object of the present invention is to provide a new and improved sensing device for stoves which is susceptible of a low cost of manufacture with regard to both materials and labor, and which accordingly is then susceptible of low prices of sale to the consuming public, thereby making such a sensing device for stoves economically available to the buying public.

Even still another object of the present invention is to provide a new and improved sensing device for stoves for detecting the absence of a pot or the like on a stove to automatically shut down a power source of the stove.

Lastly, it is an object of the present invention to provide a new and improved sensing device for stoves including a gas stove having at least one burner and a gas supply conduit for supply gas to the burner. The burner has a control dial for controlling the flow of gas to the burner. A weight sensor is disposed below the burner of the gas stove. The weight sensor is in communication with the control dial. The weight sensor sends a first signal when a cooking utensil is disposed on the burner to allow for gas to be supplied to the burner and a second signal when a cooking utensil is not disposed on the burner to stop the gas from being supplied to the burner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the sensing device for stoves constructed in accordance with the principles of the present invention.

FIG. 2 is a cross-sectional view of the present invention as taken along line 2—2 of FIG. 1.

FIG. 3 is a cross-sectional view of the present invention as taken along line 3—3 of FIG. 1.

FIG. 4*a* is an operative illustration of the present invention illustrated in FIG. 2.

FIG. 4*b* is an operative illustration of the present invention illustrated in FIG. 3.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved sensing device for stoves embodying the principles and concepts of the present invention and generally designated by the reference number 10 will be described.

Specifically, it will be noted in the various Figures that the device relates to a sensing device for stoves for detecting the absence of a pot or the like on a stove to automatically shut down a power source of the stove. In its broadest context, the device consists of a gas stove and a weight sensor. Such components are individually configured and correlated with respect to each other so as to attain the desired objective.

The gas stove 12 has at least one burner 14 and a gas supply conduit 16 for supply gas to the burner 14. The burner 14 has a control dial 18 for controlling the flow of gas to the burner 14. FIG. 1 illustrates a stove 12 that uses gas on one side and electricity on the other side. This illustration merely illustrates the use of the two different options, but does not require the use of both types of stoves in one unit.

The weight sensor 20 is disposed below the burner 14 of the gas stove 12. The weight sensor 20 is in communication with the control dial 18. The weight sensor 20 sends a first signal when a cooking utensil is disposed on the burner 14 to allow for gas to be supplied to the burner 14 and a second signal when a cooking utensil is not disposed on the burner 14 to stop the gas from being supplied to the burner 14.

Alternately, the device 10 could be incorporated into an electric stove 12. In this type of arrangement, the weight sensor would be replaced by an infrared sensor 22 that will detect the presence of a cooking utensil whereby the infrared sensor 22 will act as an electric eye that will signal to turn off the electricity to the burner 14 once the cooking utensil has been removed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A sensing device for stoves for detecting the absence of a pot or the like on a stove to automatically shut down a power source of the stove comprising, in combination:

a gas stove having at least one burner and a gas supply conduit for supply gas to the burner, the burner having a control dial for controlling the flow of gas to the burner;

a weight sensor disposed below the burner of the gas stove, the weight sensor being in communication with the control dial, the weight sensor sending a first signal when a cooking utensil is disposed on the burner to allow for gas to be supplied to the burner and a second signal when a cooking utensil is not disposed on the burner to stop the gas from being supplied to the burner.

2. A sensing device for stoves for detecting the absence of a pot or the like on a stove to automatically shut down a power source of the stove comprising, in combination:

an electric stove having at least one burner and an electric supply for supply electricity to the burner, the burner having a control dial for controlling the amount of electricity to the burner;

an infrared sensor disposed below the burner of the electric stove, the infrared sensor being in communication with the control dial, the infrared sensor sending a first signal when a cooking utensil is disposed on the burner to allow for electricity to be supplied to the burner and a second signal when a cooking utensil is not disposed on the burner to stop the electricity from being supplied to the burner.

* * * * *